United States Patent [19]

Hoffman

[11] 4,376,395

[45] Mar. 15, 1983

[54] TOOL FOR USE IN ADJUSTING ENGINE VALVES

[76] Inventor: Brent K. Hoffman, 788 W. Bullion St., Murray, Utah 84107

[21] Appl. No.: 236,209

[22] Filed: Feb. 20, 1981

[51] Int. Cl.[3] ..... B25B 9/00

[52] U.S. Cl. ..... 81/3 R

[58] Field of Search ..... 81/1 R, 3 R, 3 F; 29/214, 239, 253

[56] References Cited

U.S. PATENT DOCUMENTS

| | | | |
|---|---|---|---|
| 2,373,307 | 4/1945 | Goddard et al. | 29/253 X |
| 3,322,005 | 5/1967 | Neuschotz | 81/3 R |
| 3,949,459 | 4/1976 | Marenchin | 29/239 X |
| 4,108,025 | 8/1978 | Stine et al. | 81/3 R |

*Primary Examiner*—James G. Smith

*Attorney, Agent, or Firm*—Mallinckrodt & Mallinckrodt

[57] ABSTRACT

A tappet adjusting tool for use in replacing the adjusting pads in the valve lifters of overhead cam, internal combustion engines, such as those commonly used in motorcycles and some automobiles, includes a main tool body having a generally curved lower extension adapted to fit loosely between the cylinder head and the cam of the engine. When in proper position between the cam and cylinder head, the tool is locked into that position such as by a wedge member which is normally swung in toward the tool body but which can be biased into locking position against the cylinder head. A plunger extends from the tool extension and makes contact with the edge of the valve lifter. The plunger is extended to move the lifter and adjusting pad of the engine being worked on away from the cam so that the adjusting pad can be removed and replaced.

10 Claims, 9 Drawing Figures

TOOL FOR USE IN ADJUSTING ENGINE VALVES

BACKGROUND OF THE INVENTION

1. Field

The invention is in the field of tools for use in adjusting and replacing the adjusting pad on the tappets or valve lifters in internal combustion engines, such as the four cycle, dual overhead cam engines generally used in motorcycles and some types of automobiles.

2. State of the Art

In performing a proper tune-up of a motorcycle or similar type engine, it is necessary to determine whether the ajdusting pads in the valve lifters are of correct thickness so as to give proper valve clearance. If not, these adjusting pads must be replaced. With most current tools available, the cam shaft in the engine has to be rotated to the position where the valve is extended or opened to its maximum position, i.e. the cam lobe is in contact with the adjusting pad. A holding tool is then inserted, which is generally secured to the cylinder head using a cylinder head cover bolt hole. The cam then has to be rotated in the opposite direction so that the heel of the cam is toward the adjusting pad, thus giving clearance between the cam and the pad. The tool holds the valve lifter in its extended position while the cam is rotated to provide the clearance. Such tools have to be carefully positioned so that they catch only the bucket of the tappet and not the adjusting pad, and care has to be taken to carefully rotate the cam in only one direction after installation of the tool; otherwise, the cam may be ruined.

Another tool currently available, while not requiring rotation of the cam, is in two pieces, one of which is used to move the valve lifter against its spring tension while the other is placed to hold the valve after being so moved, these two tools require both hands to manipulate which causes problems in the small space available. Also, because one is actively working against the valve spring tension, the tools can easily slip, thereby causing injury to the worker.

In addition to the possible damage to the cam and injury to the worker that can occur using currently available tools, such tools are difficult to use and much time is expended in positioning them and rotating the cams to proper position. Using the current tools, it usually takes about half an hour or more to properly check the adjusting pads. Because of the time and difficulty involved, many times when such adjustments should be checked the mechanics do not do so.

SUMMARY OF THE INVENTION

According to the invention, a tool is provided which eliminates the necessity of rotating the cam. With the cam in position so that its heel is against the valve tappet or lifter, a tool having a main body with a lower extension curved to fit loosely between the cylinder head and the cam is moved into position. A wedge member, normally swung in toward the main body so that the curved extension can easily be placed in position between the cam and the cylinder head, allows easy positioning of the tool extension. When in position between the cam and the cylinder head, the wedge is locked into a biased position against the cylinder head so that the tool body is locked into position and cannot slide out of position between the cam and the cylinder head. A plunger extends from the curved extension of the body to the outside edge of the valve lifter. The plunger contacts the rim of the valve lifter, so does not contact the adjustment pad. When the tool is locked into position between the cam and cylinder head, the plunger is moved so as to move the valve lifter and adjusting pad away from the cam so that the adjusting pad may be easily removed. This requires no rotating of the cam and, thus, substantially decreases the chance of damage to engine parts. It makes the checking of the adjusting pads a quick and easy operation.

THE DRAWINGS

In the accompanying drawings, which represent the best mode presently contemplated for carrying out the invention:

FIG. 1 is a side elevation of one embodiment of the tool of the invention;

FIG. 2, a side elevation of the tool of FIG. 1, but rotated 90°;

FIG. 3, a side elevation of the tool of FIG. 1, rotated 180°;

FIG. 4, a vertical section taken on the line 4—4 of FIG. 1;

FIG. 5, a vertical section taken along the line 5—5 of FIG. 2;

FIG. 6, a schematic representation of the tool in position between an engine cam shaft and cylinder head, ready for use;

FIG. 7, a view similar to FIG. 6, but showing the plunger of the tool in extended position and the valve lifter spaced from the cam so that the adjusting pad can be removed;

FIG. 8, a side elevation of a second embodiment of the tool; and

FIG. 9, a vertical section taken on the line 9—9 of FIG. 8.

DETAILED DESCRIPTION OF THE ILLUSTRATED EMBODIMENTS

Figure 6:
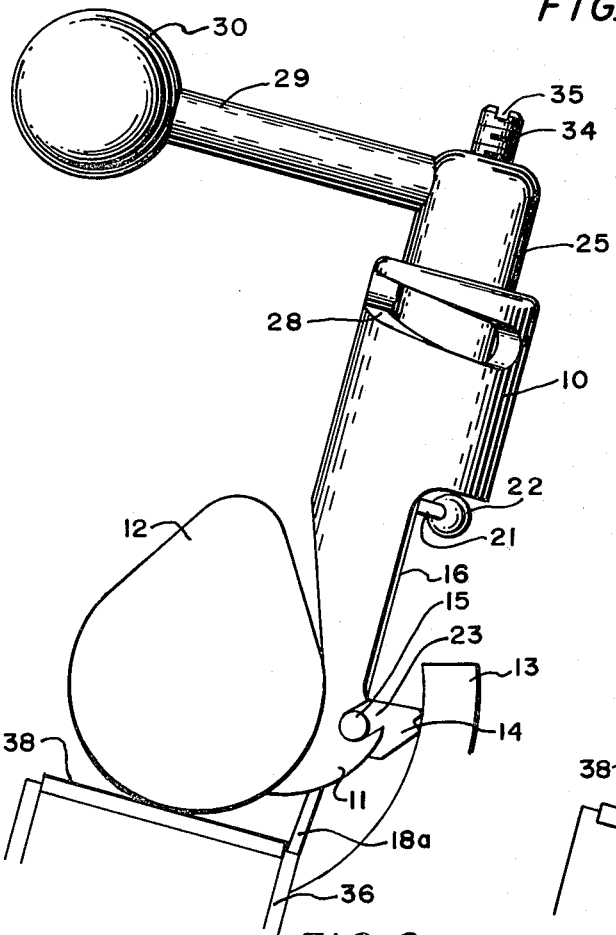
Figure 7:
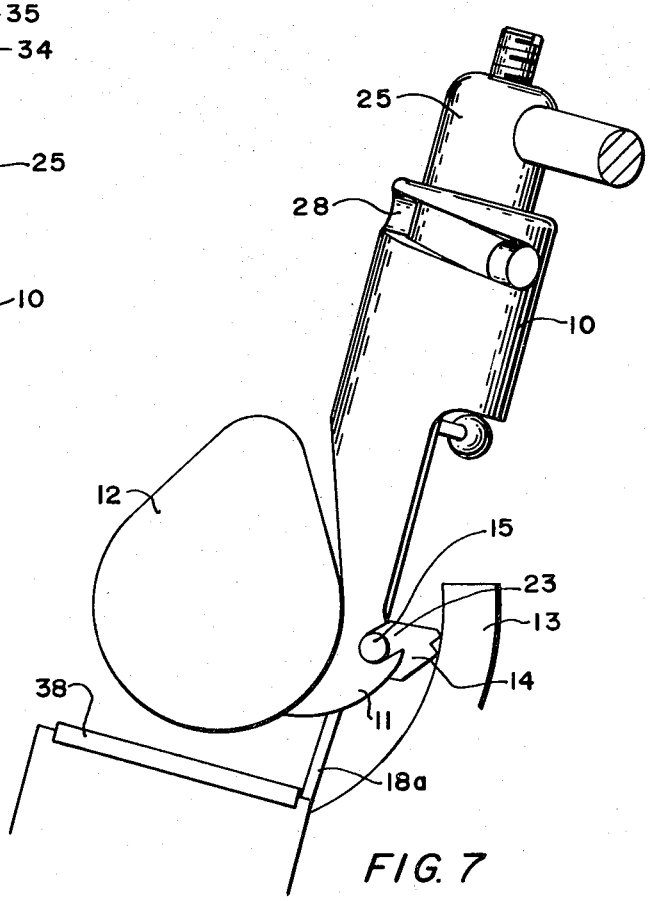

Referring to FIGS. 1 through 7, one preferred embodiment of the invention is shown and includes a main tool body 10 having a lower extension 11 which is curved so as to fit loosely in the space in a normal four cycle, dual overhead cam, internal combustion engine such as the ones commonly used in motorcycles, between the cam 12 and cylinder head 13, FIGS. 6 and 7. The curved extension does not have to fit against the cam along its length, as shown, as long as some portion fits against it. The radius of curvature may be larger than the radius of curvature of the cam.

Figure 4:
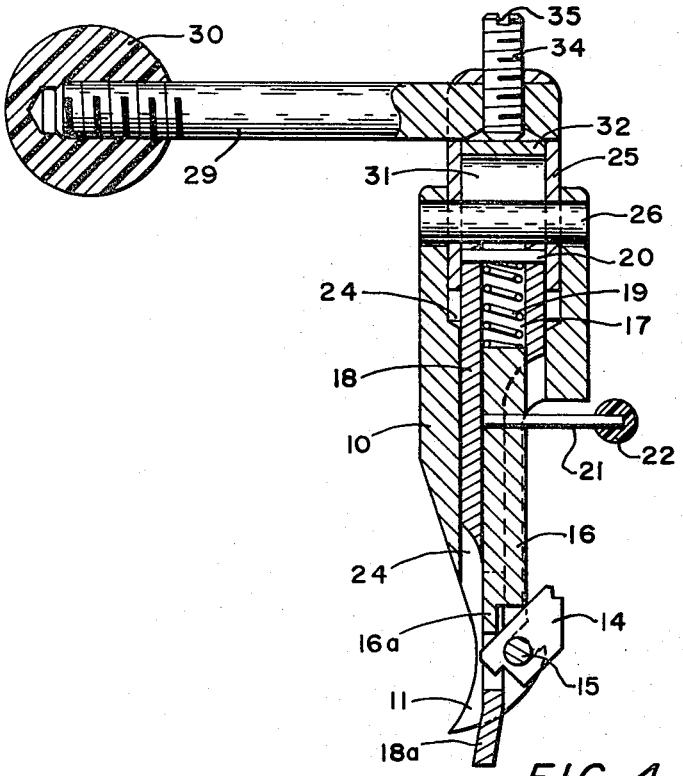
Figure 5:
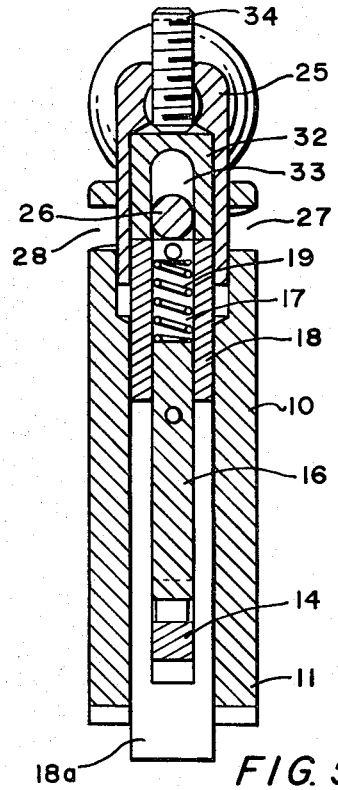

A wedge member 14 is pivotally mounted on body extension 11, as by means of a shaft 15, so that it may either be swung in toward the body of the tool or may be biased to extend outwardly from the tool. A central shaft 16 in the tool is slidably received by a central bore 17 in plunger member 18. A spring 19, positioned in bore 17 between a roll pin 20 and shaft 16, biases shaft 16 toward wedge member 14. A portion of the end of shaft 16 to wedge member 14 is cut away, so that, with the shaft 16 in position as shown in FIG. 4, the portion **16*a* of shaft 16 causes wedge member 14 to swing upwardly and in toward the tool. When shaft 16 is rotated so that the portion 16*a* is over at least a portion of wedge member shaft 15, wedge member 14 is pivoted outwardly away from the tool and is biased outwardly by spring 19 acting on shaft 16. Thus, as shaft 16 is rotated and wedge member 14 is swung and biased away from the tool, shaft 16 is forced upwardly and compresses spring 19. The amount of compression depends upon the distance wedge member 14 can pivot outwardly. Further, when in biased position, wedge member 14 can still be pivoted inwardly toward the tool and when so pivoted, will cause further compression of spring 19**.

Shaft 21 is secured to and extends outwardly from shaft 16 and has a handle 22 at its opposite end. Shaft 21 and handle 22 are used to rotate shaft 16 to place wedge member 14 in its retracted or biased positions.

Shaft 15 for wedge member 14 may be secured to wedge member 14 and may be placed into slots 23 in body extension 11, where it is held by action of shaft 16 biased against wedge member 14. With such arrangement, the wedge member 14 with shaft 15 may easily be removed by moving shaft 16 against spring 19 enough to allow shaft 15 to be withdrawn from slots 23. This arrangement is advantageous so that different size wedge members may be inserted, where necessary, to properly fit different engines.

Figure 1:
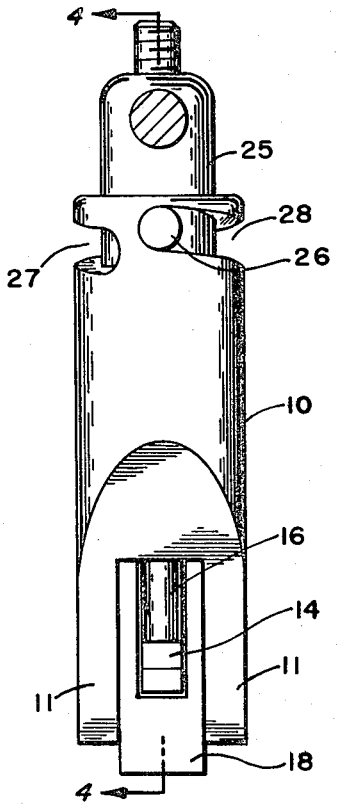
Figure 2:
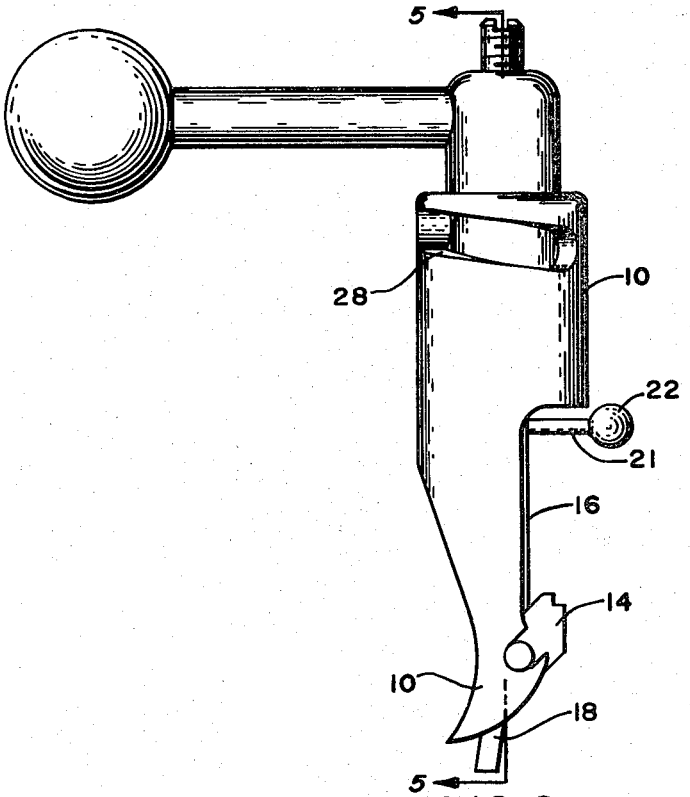
Figure 3:
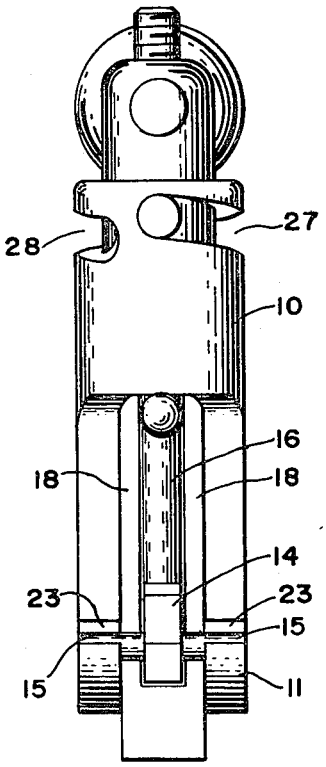

Plunger member 18 is slidably received in a central bore 24 in main tool body 10. Central bore 24 is enlarged toward the end of the body away from the extension 11 to rotatably receive therein a portion of operating member 25. Operating member 25 is held in position in main body bore 24 by means of pin 26 secured to operating member 25 and extending into slots 27 and 28 in main body member 10. Slots 27 and 28 are sloped as shown in FIGS. 1–3 so that, as operating member 25 with pin 26 is rotated and pin 26 slides in slots 27 and 28, operating member 25 moves longitudinally along the axis of bore 24 in main body 10, i.e. in the orientation of the tool in the drawings, moves up and down in relation to the main body of the tool. A shaft 29 with handle 30 extends from operating member 25 so that member 25 may be easily rotated.

Plunger member 18 extends from bore 24 in main tool body 10 into central bore 31 in operating member 25 where it abuts adjustment member 32, which is also within central bore 31 of operating member 25. Adjustment member 32 is slotted at 33 to fit about pin 26.

Adjustment screw 34 is threaded through the end of operating member 25, with its head resting against adjustment member 32 in bore 31. The other end of adjustment screw 34 is slotted at 35 to receive a screw driver or similar tool. Adjusting screw 34 is shown in its extreme upward position. As adjusting screw 34 is turned, the end of the screw against adjustment member 32 moves linearly and causes adjustment member 32 to move within central bore 31. Movement of adjusting member 32 causes movement of plunger member 18, since the two are in abutting relationship. The adjustment of screw 34 determines the distance that end **18*a* of plunger member 18** extends from the tool. This may need to be adjusted in some instances for different types of engines.

To use the tool, the engine cam is rotated so that the heel of the cam is against the valve lifter. This occrs through about 30° of cam rotation. The valve clearance is measured to determine if it is correct or if a change in adjusting pad is needed. Up to this point, the procedure is the same regardless of what type of tool is to be used if the adjusting pads needs to be changed.

If it is determined that a change of adjusting pads is needed, the tool of the invention is inserted between the cam 12 and the cylinder head 13 as illustrated in FIG. 6. When in position so that the plunger **18*a* is adjacent to the edge of the valve lifter 36, shaft 16 is rotated by means of handle 22 so that wedge member 14 is biased against cylinder head 13. The claws on wedge member 14 against cylinder head 13** hold the tool securely in place.

If the tool is adjusted for the particular engine being worked on, when the tool is in proper position the plunger **18*a* will just rest against the edge of valve lifter 36. If the tool is not adjusted for the particular engine being worked on, the plunger is adjusted by turning adjusting screw 34 until the plunger is just resting against the edge of valve lifter 36** when the tool is secured in position between the cam and engine block. It has been found that an adjustment of only about one-fifth of an inch is needed to accommodate all common motorcycle engines.

With the tool locked in position, operating member 25 is rotated by means of handle 30. This causes pin 26 to move in slots 27 and 28, causing operating member 25, adjusting member 32, and plunger 18 to move downwardly. This causes plunger **18*a* to move away from the tool and push valve lifter 36 away from cam 12, as shown in FIG. 7. The adjusting pad 38 can now be removed and replaced. Removal is commonly accomplished by use of a magnetic tool. It has been found that a clearance of one-eighth inch between cam and adjusting pad is all that is needed for replacing the adjusting pad. Accordingly, slots 27 and 28** are adapted to cause a one-eighth inch movement of the plunger.

When the replacement adjusting pad has been placed in the valve lifter, handle 30 is moved to its normal position, allowing the valve lifter to move back against the cam. Handle 22 is rotated to release wedge member 14, and the tool is removed. The valve clearance is again checked to see if it is proper. If not, the process is repeated until the proper adjusting pad is installed to give proper valve clearance.

Figure 8:
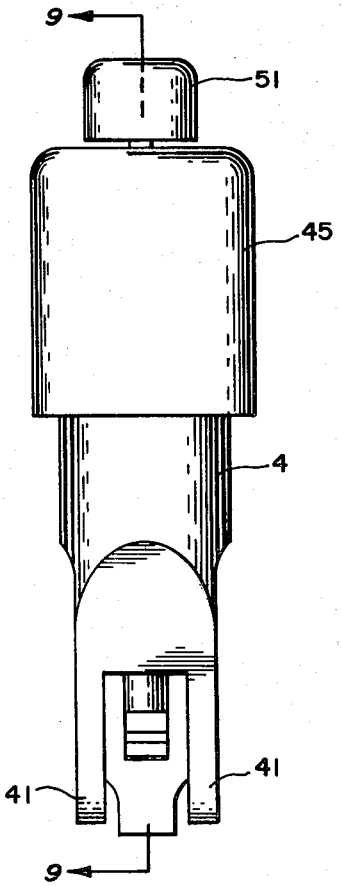
Figure 9:
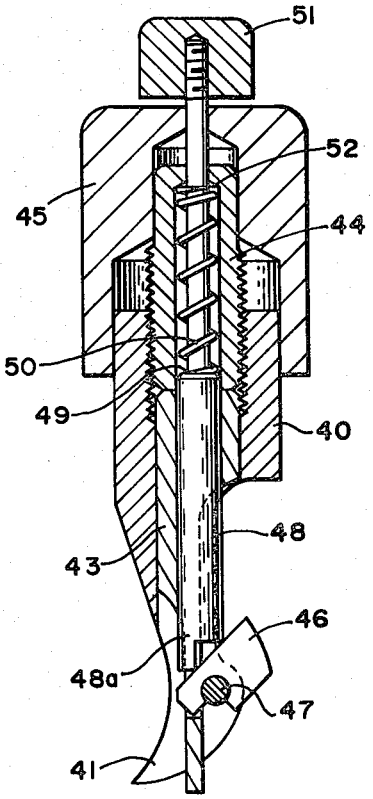

A slightly different embodiment of the tool is shown in FIGS. 8 and 9.

In this embodiment, a main tool body 40 and extension thereof 41 has the upper portion of a central bore 42 therein threaded. Plunger member 43 is slidably positioned within bore 42. A threaded adjusting member 44 is secured to a handle 45. Thus, as handle 45 is turned, adjusting member 44 turns and advances or retracts in central bore 42, depending upon the direction of rotation.

A wedge member 46 is pivotally mounted by shaft 47 in body extension 41, so that it can be biased outwardly away from the body.

A shaft 48 passes through a central bore in adjusting member 44 and through handle 45. As in the embodiment of FIGS. 1–7 already described, a portion of the end of shaft 48 adjacent wedge member 46 is cut away, so that, with the shaft 48 in position as shown in FIG. 9, the portion **48*a* of shaft 48 causes wedge member 46 to be swung upwardly and in toward the tool. When shaft 48 is rotated so that the portion 48*a* is over at least a portion of wedge member shaft 47, wedge member 46 is pivoted outwardly away from the tool. Shaft 48 is reduced in diameter part way along its length to form a shoulder 49 upon which a spring 50 rests. The reduced diameter portion of shaft 48 extends through handle 45 to handle 51 where it is secured. Spring 50 is positioned between shoulder 49 and a reduced diameter portion of the central bore in adjusting member 44, which forms shoulder 52. Spring 50 thus biases shaft 48 downwardly, so as to swing wedge member 46 upwardly toward the tool when shaft 48 is in the position shown in FIG. 9 and to pivot and bias wedge member 46 outwardly away from the tool when shaft 48 is rotated. Shaft 48 is rotated by rotating handle 51**.

The tool is used in the same way as previously described. It is locked into position by rotating handle 51. Plunger 48 is extended from the tool by turning handle 45. The handle is turned until the desired clearance is obtained. When the adjusting pad has been replaced and handle 45 is rotated in the opposite direction. The spring tension on the valve lifter causes plunger 43 to retract. When no more spring tension remains from the valve lifter on plunger 43, handle 51 is rotated to release the wedge member and the tool is removed.

Whereas this invention is here illustrated and described with specific referennce to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A tappet adjusting tool for use in replacing the adjusting pads in the valve lifters of overhead cam type internal combustion engines, comprising a main tool body having a lower extension adapted to fit loosely between the cylinder head and the cam of an internal combustion engine; a wedge member pivoted in the main tool body extension so as to be normally swung in toward the main body and such that the extension can easily be placed between the cam and the cylinder head; means for locking the wedge into biased position against the cylinder head when the extension is in position between the cam and cylinder head; plunger means associated with the tool body; and means for extending said plunger means from the body extension so as to move the lifter and the adjusting pad of the engine being worked on away from the cam, so that the adjusting pad can be removed.

2. A tappet adjusting tool according to claim 1, wherein the plunger means in retracted position extends from the body extension so as to make contact with the edge of the lifter when the body extension is in proper position between the cam and engine block.

3. A tappet adjusting tool according to claim 1, wherein the wedge member is pivotally mounted to the body extension by means of a shaft and wherein a second shaft, substantially perpendicular to the mounting shaft is biased toward the wedge member so that an end thereof abuts said wedge member, a portion of such abuting end of the second shaft being cut away so that with the second shaft in one position, its end abuts the wedge member laterally of its mounting shaft thereby swinging such wedge members in toward the tool body, and upon rotation of the second shaft, its abuting end moves over the wedge member mounting shaft causing the wedge member to pivot away from the tool body and remain biased that way, and means are also included for rotating the second shaft.

4. A tappet adjusting tool according to claim 1, wherein the wedge member is removably mounted on the tool so that it may easily be interchanged with wedge members of different dimensions.

5. A tappet adjusting tool according to claim 1, wherein the main body extension is curved to easily fit between the cam and cylinder head.

6. A tappet adjusting tool according to claim 1, wherein the tool additionally includes means for adjusting the distance by which the plunger means extends from the body extension.

7. A tappet adjusting tool according to claim 6, wherein the adjusting means includes an adjusting screw coupled to the plunger means.

8. A tappet adjusting tool according to claim 6, wherein the adjusting means includes threads associated with the plunger means which engage mating threads associated with the tool body so that rotation of one set of threads with respect to the other will cause extension or retraction of the plunger means with respect to the tool body.

9. A tappet adjusting tool according to claim 8, wherein the adjusting means also comprises the means for extending the plunger.

10. A tappet adjusting tool according to claim 1, wherein the mean for extending the plunger includes at least one inclined slot in the tool body, a pin associated with the plunger means and received by said slot, and means for moving the pin along the slot so as to cause extension and retraction of the plunger.

* * * * *